US009115913B1

(12) United States Patent
Rossi

(10) Patent No.: US 9,115,913 B1
(45) Date of Patent: Aug. 25, 2015

(54) FLUID HEATER

(75) Inventor: Andrea Rossi, Miami Beach, FL (US)

(73) Assignee: Leonardo Corporation, Miami Beach, FL (US)

( * ) Notice: Subject to any disclaimer, the term of this patent is extended or adjusted under 35 U.S.C. 154(b) by 609 days.

(21) Appl. No.: 13/420,109

(22) Filed: Mar. 14, 2012

(51) Int. Cl.
*F24J 1/00* (2006.01)

(52) U.S. Cl.
CPC ..... *F24J 1/00* (2013.01)

(58) Field of Classification Search
USPC ..... 122/16.1, 21
See application file for complete search history.

(56) References Cited

U.S. PATENT DOCUMENTS 1,400,959 A 12/1921 Koetschet
3,083,526 A * 4/1963 Hudson ..... 60/220
6,641,795 B2 11/2003 Abe
2004/0013585 A1* 1/2004 Whyatt et al. ..... 422/189
2004/0065314 A1* 4/2004 Layer et al. ..... 126/263.03
2010/0251694 A1* 10/2010 Hugus et al. ..... 60/253
2010/0252023 A1* 10/2010 Coffey et al. ..... 126/263.01
2011/0005506 A1 1/2011 Rossi

FOREIGN PATENT DOCUMENTS

EP 2341119 9/2013

* cited by examiner

*Primary Examiner* — Alissa Tompkins
*Assistant Examiner* — John Bargero
(74) *Attorney, Agent, or Firm* — Occhiuti & Rohlicek LLP

(57) ABSTRACT

An apparatus for heating fluid includes a tank for holding fluid to be heated, and a fuel wafer in fluid communication with the fluid. The fuel wafer includes a fuel mixture including reagents and a catalyst, and an electrical resistor or other heat source in thermal communication with the fuel mixture and the catalyst.

10 Claims, 5 Drawing Sheets

FLUID HEATER

FIELD OF DISCLOSURE

This disclosure relates to heat transfer systems, and in particular to devices for transferring heat to a fluid.

BACKGROUND

Many heat transfer systems use hot fluids as a heat transfer medium. Such systems include a heat generator for generating heat, a heat transfer medium in thermal communication with the energy source, and a pump to move the heated medium to wherever the heat is needed. Because of its high heat capacity and its abundance, a common heat transfer fluid is water, both in its liquid and gas phase.

A variety of heat generators are in common use. For instance, in nuclear power plants, nuclear fission provides energy for heating water. There also exist solar water heaters that use solar energy. However, most heat transfer sources rely on an exothermal chemical reaction, and in particular, on combustion of some fuel.

SUMMARY

In one aspect, the invention features an apparatus for heating fluid, the apparatus including a tank for holding fluid to be heated, and a fuel wafer in fluid communication with the fluid, the fuel wafer including a fuel mixture including reagents and a catalyst, and a heat source, for example an electrical resistor, in thermal communication with the fuel mixture and the catalyst.

Among the embodiments are those in which the fuel mixture includes lithium and lithium aluminum hydride, those in which the catalyst includes a group 10 element, such as nickel in powdered form, or in any combination thereof.

In other embodiments, the catalyst in powdered form, has been treated to enhance its porosity. For example, the catalyst can be nickel powder that has been treated to enhance porosity thereof.

In those embodiments that include an electrical resistor, the apparatus can also include an electrical energy source, such as a voltage source or current source in electrical communication with the resistor.

Among the other embodiments are those in which the fuel wafer includes a multi-layer structure having a layer of the fuel mixture in thermal communication with a layer containing the electrical resistor.

In yet other embodiments, the fuel wafer includes a central heating insert and a pair of fuel inserts disposed on either side of the heating insert.

A variety of tanks can be used. For example, in some embodiments, the tank includes a recess for receiving the fuel wafer therein. Among these are embodiments in which the tank further includes a door for sealing the recess. In yet other embodiments the tank includes a radiation shield.

Also included among the embodiments are those that further include a controller in communication with the voltage source. Among these are controllers that are configured to cause vary the voltage in response to temperature of the fluid to be heated.

In another aspect, the invention features an apparatus for heating a fluid, the apparatus including means for containing the fluid, and means for holding a fuel mixture containing a catalyst and a reagent, and means for initiating a reaction sequence mediated by the catalyst to cause an exothermic reaction.

Another aspect of the invention is a composition of matter for generating heat, the composition including a mixture of porosity-enhanced nickel powder, lithium powder, and lithium aluminum powder, and a heat source in thermal communication with the mixture for initiating a nickel catalyzed exothermic reaction.

Another aspect of the invention is a method of heating a fluid, the method including placing a mixture of nickel powder, lithium powder, and lithium aluminum hydride in thermal communication with the fluid; and heating the mixture, thereby initiating an exothermic reaction in the mixture.

These and other features of the invention will be apparent from the following detailed description and the accompanying figures, in which:

DETAILED DESCRIPTION

Figure 1:
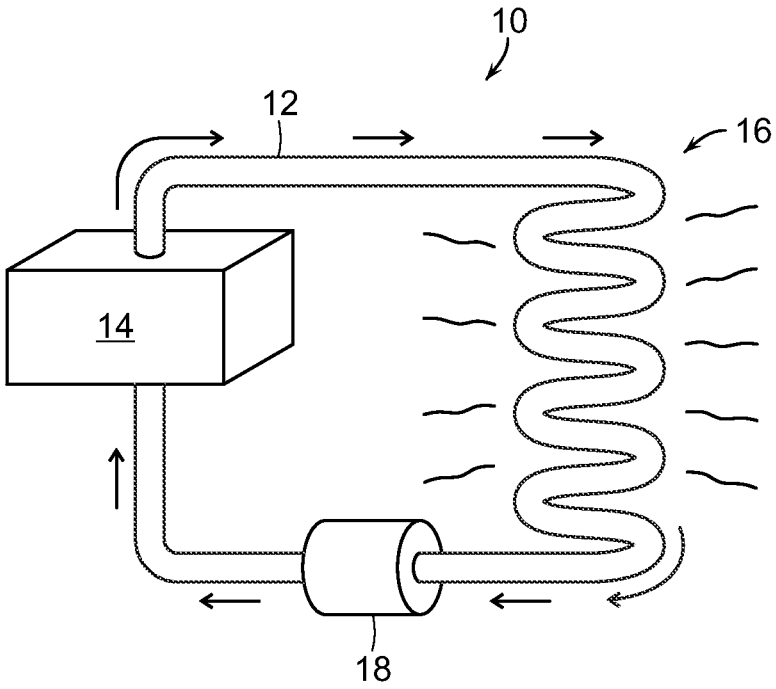
FIG. 1 shows a heat transfer system having a heat source.

Referring to FIG. 1, a heat transfer system 10 includes a pipe 12 for transporting a heated fluid in a closed loop between a heat source 14 and a thermal load 16. In most cases, for example where there is hydraulic resistance to be overcome, a pump 18 propels the heated fluid. However, in some cases, such as where the heated fluid is steam, the fluid's own pressure is sufficient to propel the fluid. A typical thermal load 16 includes radiators such as those commonly used for heating interior spaces.

Figure 2:
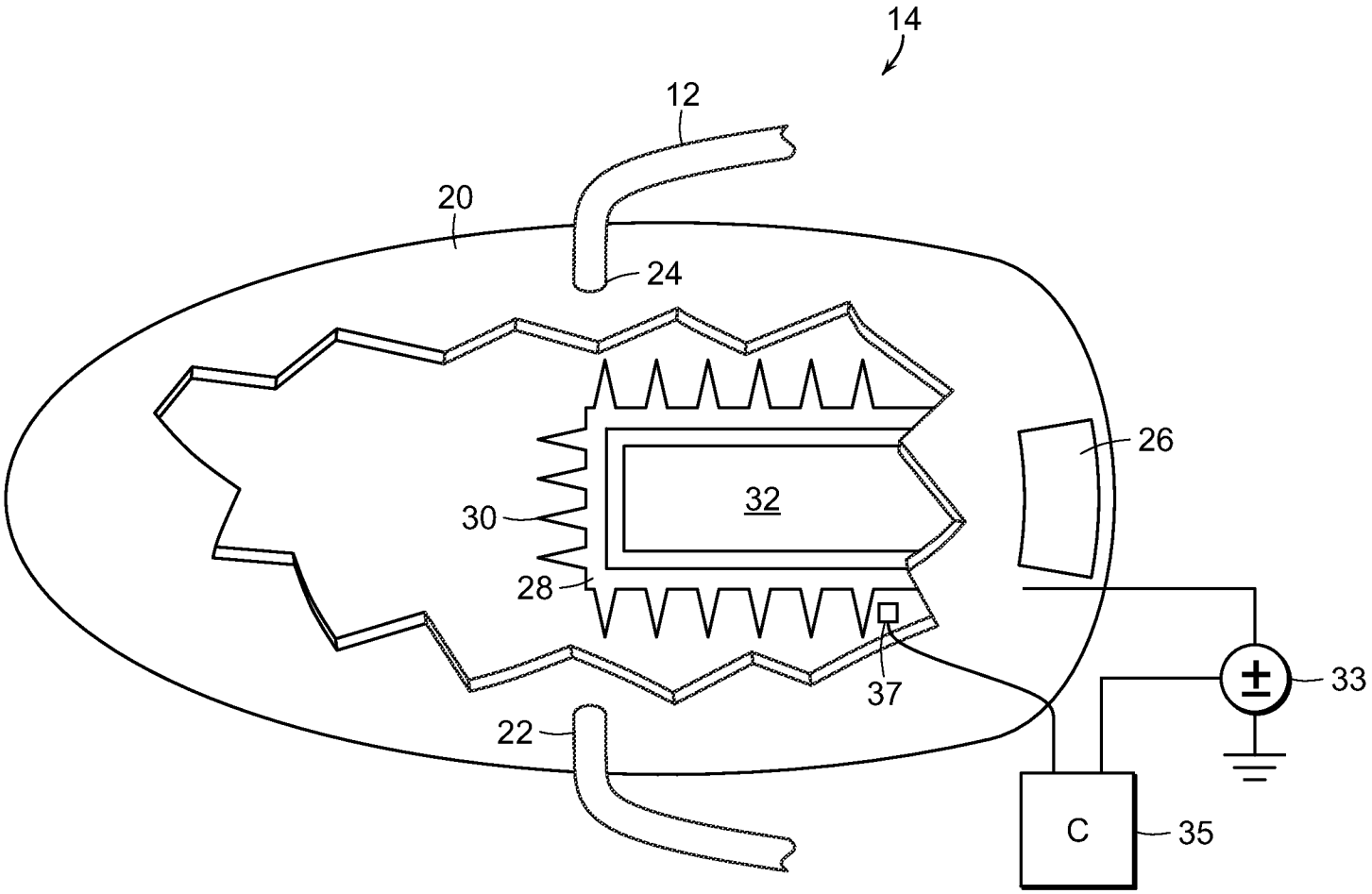
FIG. 2 is a cut-away view of the heat source in FIG. 1.

As shown in FIG. 2, the heat source 14 is a tank 20 having a lead composite shield, an inlet 22 and an outlet 24, both of which are connected to the pipe 12. The interior of the tank 20 contains fluid to be heated. In many cases, the fluid is water. However, other fluids can be used. In addition, the fluid need not be a liquid fluid but can also be a gas, such as air.

The tank 20 further includes a door 26 that leads to a receptacle 28 protruding into the tank 20. Radiating fins 30 protrude from walls of the receptacle 28 into the tank 20. To maximize heat transfer, the receptacle 28 and the fins 30 are typically made of a material having high thermal conductivity, such as metal. A suitable metal is one not subject to corrosion, such as stainless steel.

The receptacle 28 holds a multi-layer wafer 32 for generating heat. A voltage source 33 is connected to the wafer 32, and a controller 35 for controlling the voltage source 33 in response to temperature of fluid in the tank 12 as sensed by a sensor 37.

Figure 3:
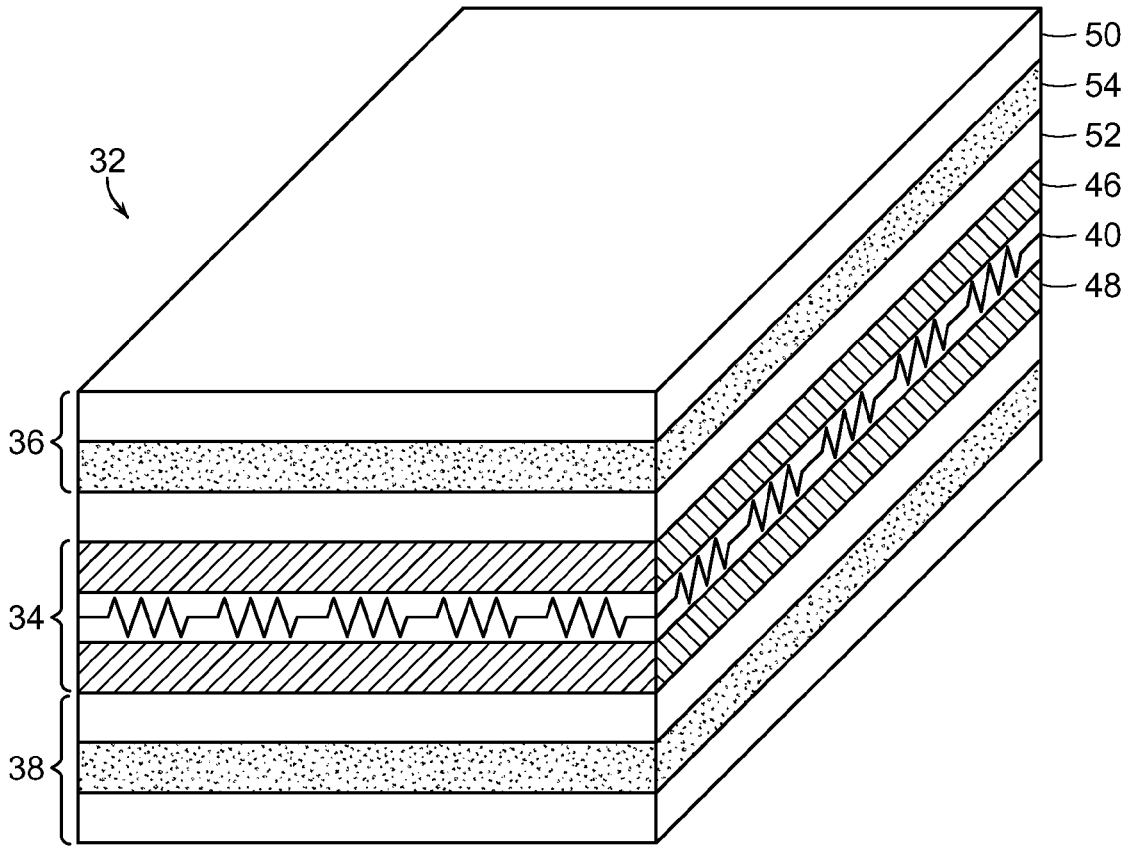
FIG. 3 is a cross-section of the wafer for use in the heat source of FIG. 2.
Figure 4:
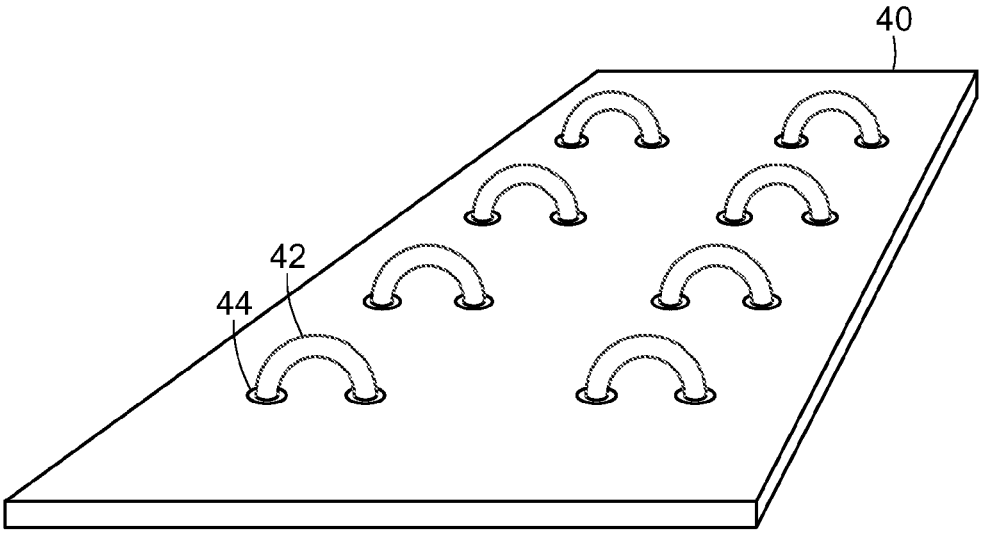
FIG. 4 shows an exemplary resistor in the central layer of the wafer shown in FIG. 3.

As shown in FIG. 3, the multilayer fuel wafer 32 includes a heating section 34 sandwiched between two fuel sections 36, 38. The heating section 34 features a central layer 40 made of an insulating material, such as mica, that supports a resistor 42. FIG. 4 shows an exemplary central layer 40 having holes 44 through which a resistive wire 42 has been wound. This resistive wire 42 is connected to the voltage source 33. First and second insulating layers 46, 48, such as mica layers, encase the central layer 40 to provide electrical insulation from the adjacent fuel sections 36, 38.

Each fuel section 36, 38 features a pair of thermally conductive layers 50, 52, such as steel layers. Sandwiched between each pair of conductive layers 50, 52 is a fuel layer 54 that contains a fuel mixture having nickel, lithium, and lithium aluminum hydride $LiAlH_4$ ("LAH"), all in powdered form. Preferably, the nickel has been treated to increase its porosity, for example by heating the nickel powder to for times and temperatures selected to superheat any water present in micro-cavities that are inherently in each particle of nickel powder. The resulting steam pressure causes explosions that create larger cavities, as well as additional smaller nickel particles.

The entire set of layers is welded together on all sides to form a sealed unit. The size of the wafer 32 is not important to its function. However, the wafer 32 is easier to handle if it is on the order of ⅓ inch thick and 12 inches on each side. The steel layers 50, 52 are typically 1 mm thick, and the mica layers 40, 48, which are covered by a protective polymer coating, are on the order of 0.1 mm thick. However, other thicknesses can also be used.

In operation, a voltage is applied by the voltage source 33 to heat the resistor 42. Heat from the resistor 42 is then transferred by conduction to the fuel layers 54, where it initiates a sequence of reactions, the last of which is reversible. These reactions, which are catalyzed by the presence of the nickel powder, are:

$$3LiAlH_4 \rightarrow Li_3AlH_6 + 2Al + 3H_2$$

$$2Li_3AlH_6 \rightarrow 6LiH + 2Al + 3H_2$$

$$2LiH + 2Al \rightarrow 2LiAl + H_2$$

Once the reaction sequence is initiated, the voltage source 33 can be turned off, as the reaction sequence is self-sustaining. However, the reaction rate may not be constant. Hence, it may be desirable to turn on the voltage source 33 at certain times to reinvigorate the reaction. To determine whether or not the voltage source 33 should be turned on, the temperature sensor 37 provides a signal to the controller 35, which then determines whether or not to apply a voltage in response to the temperature signal. It has been found that after the reaction has generated approximately 6 kilowatt hours of energy, it is desirable to apply approximately 1 kilowatt hour of electrical energy to reinvigorate the reaction sequence.

Eventually, the efficiency of the wafer 32 will decrease to the point where it is uneconomical to continually reinvigorate the reaction sequence. At this point, the wafer 32 can simply be replaced. Typically, the wafer 32 will sustain approximately 180 days of continuous operation before replacement becomes desirable.

The powder in the fuel mixture consists largely of spherical particles having diameters in the nanometer to micrometer range, for example between 1 nanometer and 100 micrometers. Variations in the ratio of reactants and catalyst tend to govern reaction rate and are not critical. However, it has been found that a suitable mixture would include a starting mixture of 50% nickel, 20% lithium, and 30% LAH. Within this mixture, nickel acts as a catalyst for the reaction, and is not itself a reagent. While nickel is particularly useful because of its relative abundance, its function can also be carried out by other elements in column 10 of the periodic table, such as platinum or palladium.

Figure 5:
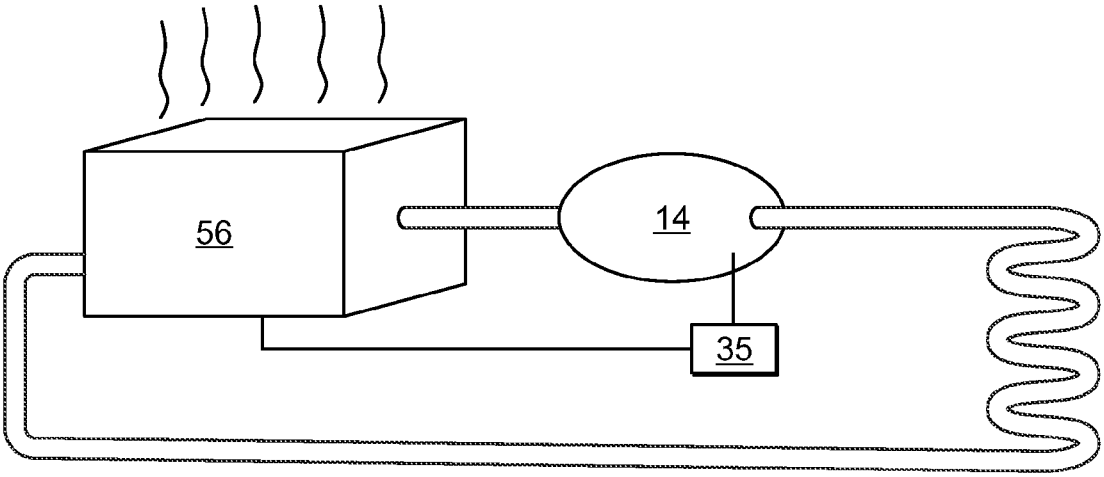
FIG. 5 shows the heat source of FIG. 1 operating with a conventional furnace.
Figure 6:
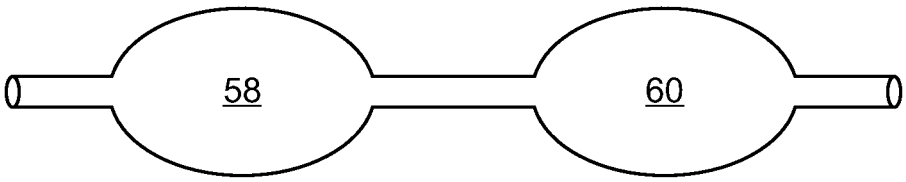
FIG. 6 shows plural heat sources like that in FIG. 2 connected in series.
Figure 7:
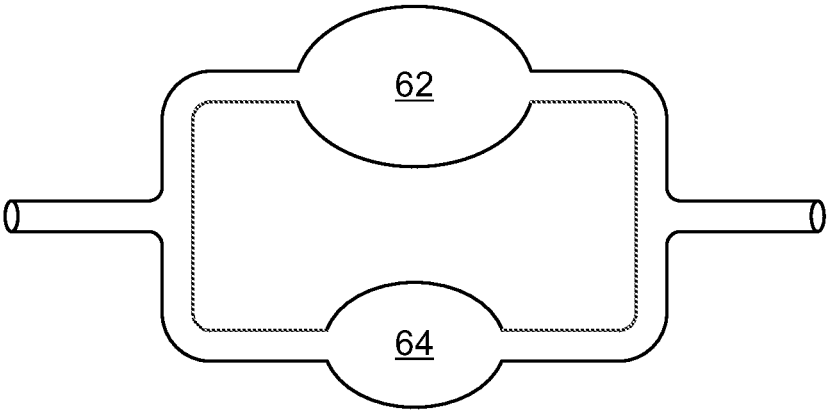
FIG. 7 shows plural heat sources like that in FIG. 2 connected in parallel.

FIGS. 5-7 show a variety of ways to connect the heat source 14 in FIG. 1.

In FIG. 5, the heat source 14 is placed downstream from a conventional furnace 56. In this case, the controller 35 is optionally connected to control the conventional furnace. As a result, the conventional furnace 56 will remain off unless the output temperature of the heat source 14 falls below some threshold, at which point the furnace 56 will start. In this configuration, the conventional furnace 56 functions as a back-up unit.

In FIG. 6, first and second heat sources 58, 60 like that described in FIGS. 1-4 are connected in series. This configuration provides a hotter output temperature than can be provided with only a single heat source 58 by itself. Additional heat sources can be added in series to further increase the temperature.

In FIG. 7, first and second heat sources 62, 64 like that described in FIGS. 1-4 are connected in parallel. In this configuration, the output volume can be made greater than what could be provided by a single heat transfer unit by itself. Additional heat transfer units can be added in parallel to further increase volume.

Having described the invention, and a preferred embodiment thereof, what I claim as new and secured by Letters Patent is:

1. An apparatus for heating fluid, said apparatus comprising a tank, an electrical resistor, and a fuel wafer, wherein said tank is configured for holding fluid to be heated, wherein said fuel wafer is configured to be in thermal communication with said fluid, wherein said fuel wafer includes a fuel mixture that includes reagents and a catalyst, wherein said electrical resistor is in thermal communication with said fuel mixture and said catalyst, wherein said resistor is configured to be coupled to a voltage source, wherein said apparatus further comprises a controller in communication with said voltage source, and a temperature sensor, wherein said fuel mixture comprises lithium, and lithium aluminum hydride, wherein said catalyst comprises a group 10 element, wherein said controller is configured to monitor a temperature from said temperature sensor, and, based at least in part on said temperature, to reinvigorate a reaction in said fuel mixture, wherein reinvigorating said reaction comprises varying a voltage of said voltage source.

2. The apparatus of claim 1, wherein said catalyst comprises nickel powder.

3. The apparatus of claim 2, wherein said nickel powder has been treated to enhance porosity thereof.

4. The apparatus of claim 1, wherein said fuel wafer comprises a multi-layer structure having a layer of said fuel mixture in thermal communication with a layer containing said electrical resistor.

5. The apparatus of claim 1, wherein said fuel wafer comprises a central heating insert and a pair of fuel inserts disposed on either side of said heating insert.

6. The apparatus of claim 1, wherein said tank comprises a recess for receiving said fuel wafer therein.

7. The apparatus of claim 6, wherein said tank further comprises a door for sealing said recess.

8. The apparatus of claim 1, wherein said tank comprises a radiation shield.

9. The apparatus of claim 1, wherein said reaction in said fuel mixture is at least partially reversible.

10. The apparatus of claim 9, wherein said reaction comprises reacting lithium hydride with aluminum to yield hydrogen gas.

* * * * *

UNITED STATES PATENT AND TRADEMARK OFFICE

CERTIFICATE OF CORRECTION

PATENT NO. : 9,115,913 B1
APPLICATION NO. : 13/420109
DATED : August 25, 2015
INVENTOR(S) : Andrea Rossi It is certified that error appears in the above-identified patent and that said Letters Patent is hereby corrected as shown below:

In the Specification

In column 3, delete lines 3 through 14 and insert this paragraph.

--Each fuel section 36, 38 features a pair of thermally conductive layers 50, 52, such as steel layers. Sandwiched between each pair of conductive layers 50, 52 is a fuel layer 54 that contains a fuel mixture having nickel, lithium, and lithium aluminum hydride LiAlH4 ("LAH"), all in powdered form. Preferably, the nickel has been treated to increase its porosity, for example by heating the nickel powder for times and temperatures selected to superheat any water present in micro-cavities that are inherently in each particle of nickel powder. The resulting steam pressure causes explosions that create larger cavities, as well as additional smaller nickel particles.--

Signed and Sealed this
Eighth Day of March, 2016

Michelle K. Lee

Michelle K. Lee
*Director of the United States Patent and Trademark Office*